US012690677B2

(12) United States Patent
Zimmer et al.

(10) Patent No.: US 12,690,677 B2
(45) Date of Patent: Jul. 28, 2026

(54) RETROFITTABLE DRAWER SLIDE ACCELERATION AND DECELERATION SYSTEM

(71) Applicants: Günther Zimmer, Rheinau (DE); Martin Zimmer, Rheinau (DE)

(72) Inventors: Günther Zimmer, Rheinau (DE); Martin Zimmer, Rheinau (DE)

( * ) Notice: Subject to any disclaimer, the term of this patent is extended or adjusted under 35 U.S.C. 154(b) by 84 days.

(21) Appl. No.: 18/944,723

(22) Filed: Nov. 12, 2024

(65) Prior Publication Data

US 2025/0194798 A1 Jun. 19, 2025

(30) Foreign Application Priority Data

Nov. 14, 2023 (DE) ..... 10 2023 004 608.6

(51) Int. Cl.
*A47B 88/46* (2017.01)
*A47B 88/467* (2017.01)

(52) U.S. Cl.
CPC ..... *A47B 88/46* (2017.01); *A47B 88/467* (2017.01); *A47B 2210/0094* (2013.01)

(58) Field of Classification Search
CPC ..... A47B 88/46; A47B 2210/0094; A47B 88/467; A47B 88/463; A47B 88/47; A47B 88/473; A47B 88/477; E05F 1/16; E05F 1/10; E05F 5/08; E05F 5/003; E05Y 2600/502
See application file for complete search history.

(56) References Cited

U.S. PATENT DOCUMENTS

| | | | | |
|---|---|---|---|---|
| 8,414,094 | B2 | 4/2013 | Chi et al. | |
| 2011/0317946 | A1* | 12/2011 | Brunner | A47B 88/40 384/26 |
| 2013/0088132 | A1* | 4/2013 | Hammerle | A47B 88/46 312/319.1 |
| 2018/0055225 | A1* | 3/2018 | Chen | A47B 88/49 |
| 2018/0216383 | A1* | 8/2018 | Molloy | E05F 3/227 |
| 2018/0231257 | A1* | 8/2018 | Rehage | A47B 88/473 |
| 2019/0008276 | A1* | 1/2019 | Goetz | A47B 88/467 |
| 2019/0024429 | A1* | 1/2019 | Wang | E05F 5/08 |
| 2020/0154885 | A1* | 5/2020 | Meusburger | A47B 88/49 |
| 2021/0293416 | A1* | 9/2021 | Homburg | F24C 15/168 |
| 2021/0388656 | A1* | 12/2021 | Zimmer | E05F 1/16 |

FOREIGN PATENT DOCUMENTS

| | | | |
|---|---|---|---|
| DE | 102021106384 | A1 | 9/2022 |
| DE | 102022003806 | A1 | 4/2024 |

* cited by examiner

*Primary Examiner* — Hiwot E Tefera
(74) *Attorney, Agent, or Firm* — Smartpat PLC

(57) ABSTRACT

A combined acceleration and deceleration system for use on a drawer system has a C-shaped drawer guide rail and a drawer guided therein. A housing in which a driving element loaded by means of a deceleration apparatus and an energy storage device can be moved between a non-positively and/or positively secured parking position and an end position. The housing has a first adapter and a second adapter. Each adapter has an engagement arm and a reach-around arm, which each have a free end. The free end of the engagement arm is orientated normal to the free end of the reach-around arm. The first adapter is a locking adapter, the engagement arm of which is at least twice as long in at least two mutually orthogonal directions as the engagement arm of the second adapter forming a guide adapter.

10 Claims, 4 Drawing Sheets

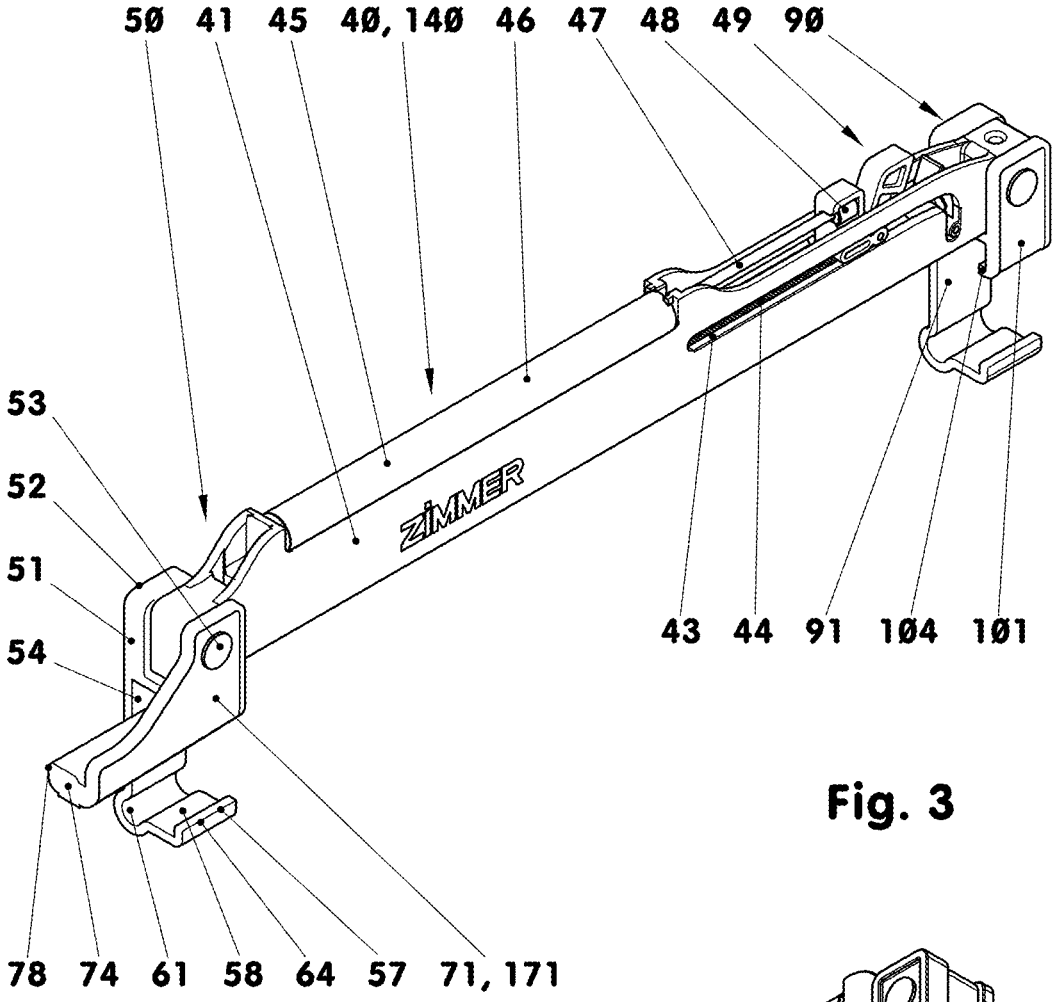
Fig. 3
Fig. 4
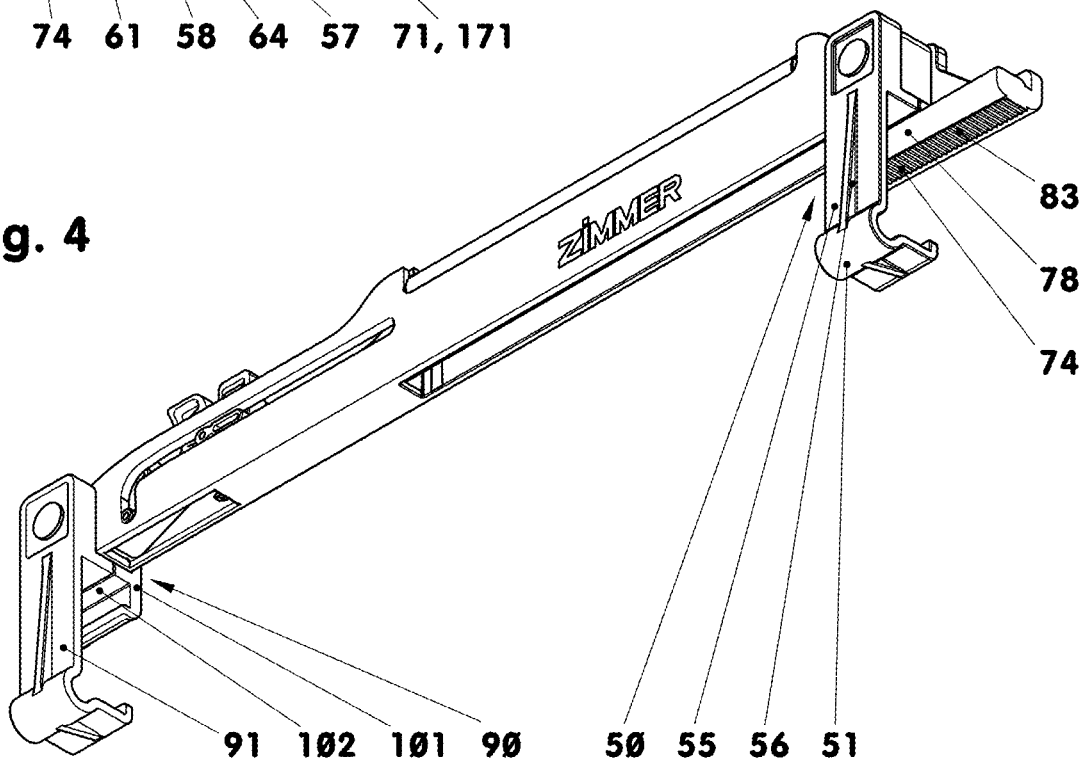

RETROFITTABLE DRAWER SLIDE ACCELERATION AND DECELERATION SYSTEM

CROSS-REFERENCE TO RELATED APPLICATION

This application claims the benefit of German Patent Application DE 10 2023 004 608.6, filed on Nov. 14, 2023, the content of which is incorporated in its entirety.

BACKGROUND

A retractable device is known from U.S. Pat. No. 8,414,094 B2, which is fixed to the body of a piece of furniture and cooperates with an extendable drawer.

SUMMARY

The disclosure relates to a combined acceleration and deceleration system for application to a drawer system having a C-shaped drawer guide rail and a drawer designed therein, having a housing in which a driving element loaded by means of a deceleration apparatus and an energy storage device, can be moved between a non-positively and/or positively secured parking position and an end position.

The present invention enables retrofitting a combined acceleration and deceleration system to a guide rail with little effort.

This is achieved with the acceleration and deceleration system as disclosed herein. For this purpose, the housing supports a first adapter and a second adapter. Each adapter has an engagement arm and a reach-around arm which each have a free end. The free end of the engagement arm is orientated normal to the free end of the reach-around arm. The first adapter is a locking adapter, the engagement arm of which is at least twice as long in at least two mutually orthogonal directions as the engagement arm of the second adapter forming a guide adapter.

The acceleration and deceleration system has a locking adapter and a guide adapter. The locking adapter non-positively secures the position of the acceleration and deceleration system to the guide rail. The guide adapter prevents loss of contact of the drawer with the acceleration and deceleration system. For mounting, the acceleration and deceleration system is attached to the guide rail so that the engagement arms of both adapters engage into the guide rail. Subsequently, the acceleration and deceleration system is pivoted around a pivot axis orientated in the longitudinal direction, until the reach-around arms latch to the guide rail. The use of a tool is not required for this, so that the acceleration and deceleration system can be retrofitted to a guide rail without a problem.

BRIEF DESCRIPTION OF THE DRAWINGS

FIG. 3: Combined acceleration and deceleration system obliquely from above;

FIG. 4: like FIG. 3, however obliquely from below;

DETAILED DESCRIPTION

Figure 1:
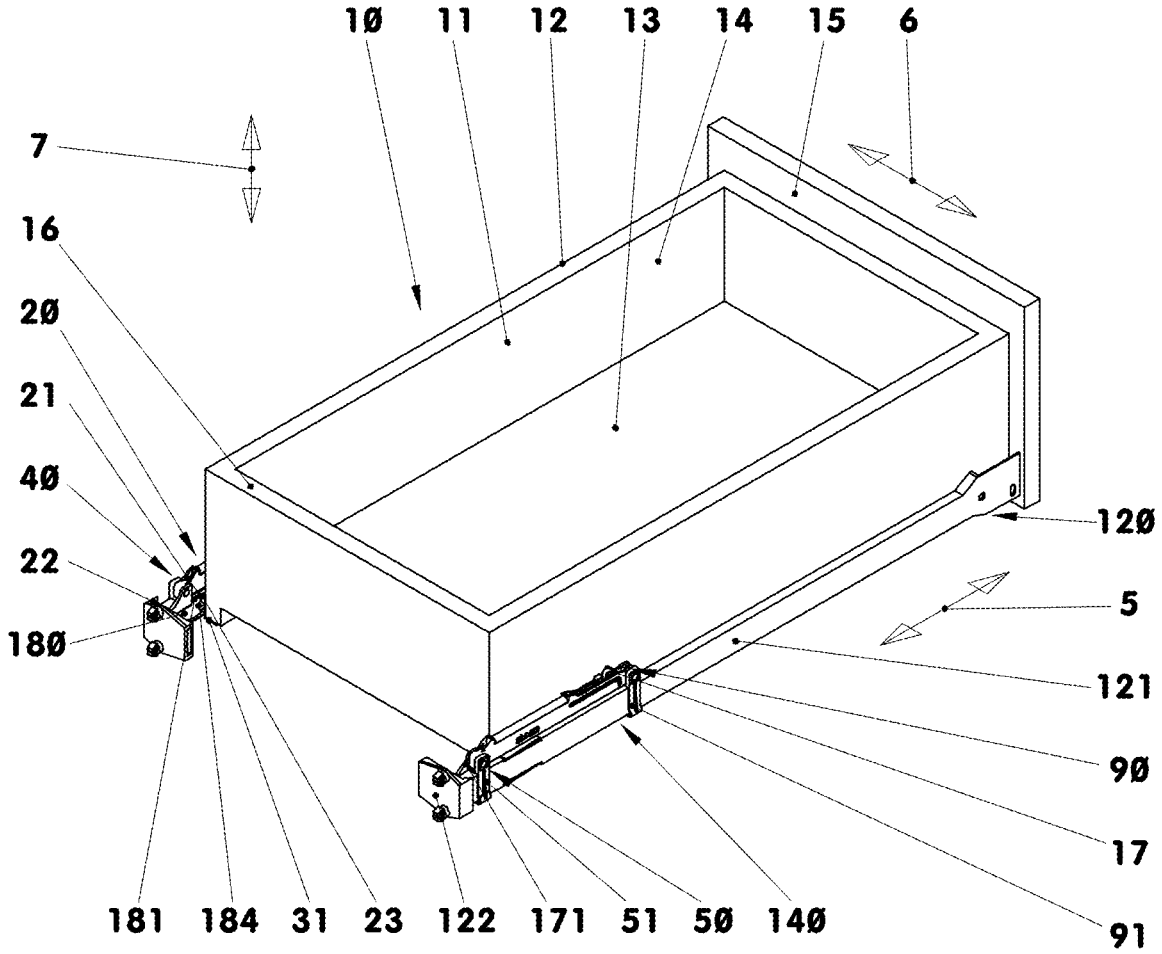
FIG. 1: System consisting of two guide rails having a drawer.

FIG. 1 shows a system (10) consisting of two guide systems (20, 120) having a drawer (11) inserted therein. This system (10) can be arranged in a cabinet. The individual guide system (20, 120) has a body-side guide rail (21, 121) and a drawer-side mounting rail (31). Additionally, the individual mounting rail (31) has a roller, for example, which rolls in the assigned guide rail (21, 121). The drawer (11) can be displaced along the guide rails (21, 121) between a closed position and an open position and back again.

In the representation of FIG. 1, the individual guide rail (21, 121) can be fixed onto the body of the cabinet with its end pointing towards the drawer opening. The other end orientated towards the rear wall of the cabinet is arranged in a thrust bearing (22, 122) to be displaceable in the transverse direction (6).

In the exemplary embodiment, the individual guide rail (21, 121) has a C-shaped profile. The two guide rails (21, 121), which jointly support a drawer (11), of a set of guide rails are arranged as mirror images of each other. The openings (23, 123) of both profiles point towards each other. The individual guide rail has an upper web (24) having a reach-around arm (25), a rear web (26) and a lower web (27). The reach-around arm (25) is arranged on the free end of the upper web (24) and points in the direction of the lower web (27). Each transition between the individual webs (24, 25; 24, 26; 26, 27) has a rounded form, and the mentioned webs are arranged perpendicular to each other. The upper web (24) and the lower web (27) have the same width. In the region near the wall, the lower web (27) and the upper web (24) of both guide rails (21, 121) have a bulge (28) directed downwards.

The drawer (11) has a drawer compartment (12) and supports a mounting rail (31, 131) on each side. The drawer compartment (12) has a rectangular construction, for example. The drawer compartment has a base (13), two longitudinal walls (14) orientated in the longitudinal direction (5), a front transverse wall (15) and a rear transverse wall (16). The front transverse wall (15) has a handle for operating the drawer (11) on its outer side, for example. This front transverse wall (15) can be designed to be higher than the other walls.

The rollers can be arranged near to the rear transverse wall (16) of the drawer (11). They project above the mounting rails (31, 131), e.g. in the vertical direction (7). When the drawer (11) is mounted, they run on the lower webs (27) of the guide rails (21, 121).

Above the mounting rails (31, 131), a driver (17) is fixed on each of the longitudinal walls (14) of the drawer (11). This is formed in a pin-like construction, for example. In each case, the driver (17) protrudes in the transverse direction (6) from the longitudinal wall (14).

Figure 2:
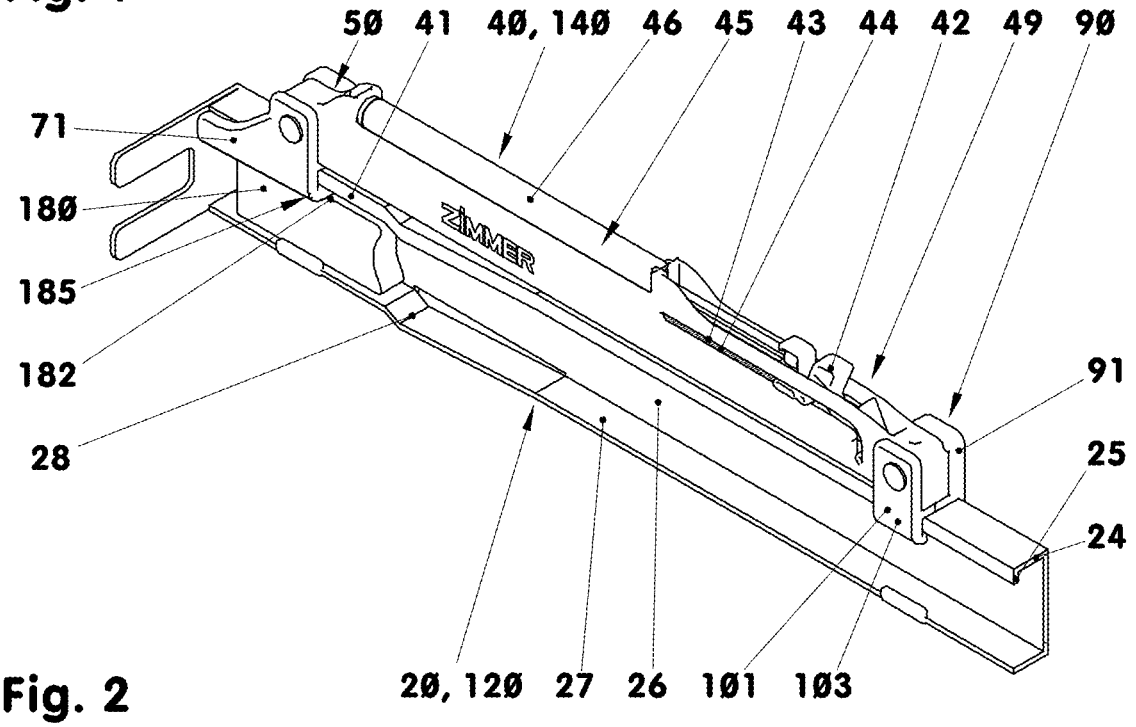
FIG. 2: Guide rail having a combined acceleration and deceleration system.

In the representation of FIG. 1, each of the guide rails (21; 121) support a combined acceleration and deceleration system (40; 140). FIG. 2 shows such an acceleration and deceleration system (40; 140) on a guide system (20; 120). The other guide system (120; 20) with its acceleration and deceleration system (140; 40) is formed as a mirror image thereto.

The individual acceleration and deceleration system (40; 140), see FIGS. 3 and 4, has a housing (41), in which a driving element (42) can be moved between a non-positively and/or positively secured parking position (49) and an end position and back again. The driving element (42) is guided along a guide track (43) or a guide slot. An energy storage device (44), e.g. a spring element (44), is mounted on the housing (41) and loads the driving element (42) in the direction of the end position. A cylinder-piston unit (45) is arranged in the housing (41) as a deceleration apparatus (45). In the exemplary embodiment, this is a hydraulic cylinder-piston unit (45) having a spring return. The use of a pneumatic cylinder-piston unit (45) is also conceivable. The cylinder (46) of the cylinder-piston unit (45) is fixed in the housing (41). The piston is connected to a piston rod (47), which protrudes from the cylinder (46). The piston rod head (48) of the piston rod (47) is pivotably mounted in the driving element (42).

In the exemplary embodiment, two adapters (50, 90) are releasably fixed on the housing (41). The adapters (50, 90) can also be moulded onto the housing (41). Also, in this case, the housing (41) supports the two adapters (50, 90). The adapters (50, 90) each sit on one end of the housing (41) that is orientated in the longitudinal direction (5). A first adapter (50) of this adapter (50, 90) is fixed on the housing end facing away from the parking position (49). A second adapter (90) sits on the housing (42) end adjacent to the parking position (49).

Each of the adapters (50; 90) has two cantilevered, at least partially parallel arms (51, 71; 51; 171; 91, 101). A first arm (51; 91) is a reach-around arm (51; 91). The second arm (71; 171; 101) is an engagement arm (71; 171; 101). Both arms (51, 71; 51; 171; 91, 101) jut out in the same direction, i.e. downwards. In the exemplary embodiment, the reach-around arms (51, 91) of both adapters (50, 90) of a combined acceleration and deceleration system (40; 140) are formed identically. However, they can also have a different design. Both adapters (50, 90) are produced from polyoxymethylene (POM), for example.

Figure 5:
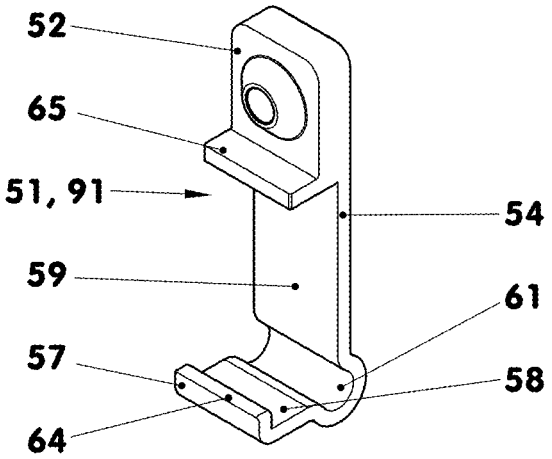
FIG. 5: Isometric view of a reach-around arm.
Figure 6:
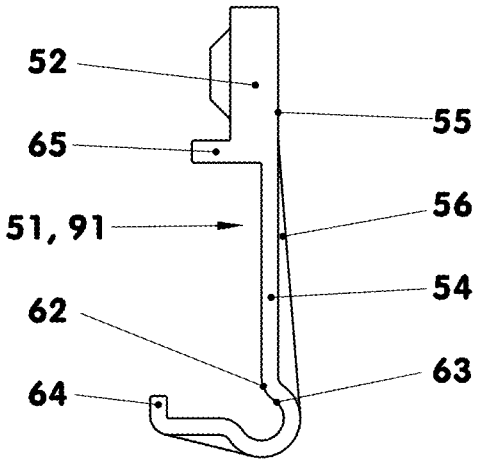
FIG. 6: End view of the reach-around arm from FIG. 5.

The individual reach-around arm (51; 91), see FIGS. 5 and 6, has a receiver support (52), to which the reach-around arm (51; 91) is fixed on the housing (41). For example, the reach-around arm (51; 91) and the respectively assigned engagement arm (71; 171; 101) are secured on the housing by means of a through bolt (53). A bearing web (54) is adjacent to the receiver support (52) of the reach-around arm (51; 91). For example, the receiver support (52) and the bearing web (54) transition into each other. A stiffening web (56) is moulded on the outer side (55) of the bearing web (54), the cross-section of which stiffening web increases from the receiver support (52) in the direction of the free end (57) of the reach-around arm (51). The length of the bearing web (54) in the vertical direction corresponds to the height of the guide rail (21), for example. In the longitudinal direction (5), the length of the reach-around arm (51; 91), for example, corresponds sevenfold to the minimum thickness of the reach-around arm (51; 91). A supporting web (65) orientated in the longitudinal direction (5) is moulded on the inner side of the bearing web (54).

Each of the reach-around arms (51; 91) has a reach-under web (58). This intersects the vertical central longitudinal plane of the combined acceleration and deceleration system (40; 140). The reach-under web (58) is orientated normal to the plane of a contact surface (59) of the bearing web (54). The transition of the bearing web (54) into the reach-under web (58) is formed as a curved section (61). This curved section (61) has, for example, a lug-shaped cross-sectional surface having a funnel-shaped inlet section (62) and a, for example, semicircular transition section (63). The inlet section (62) is convex. It has an opening angle of approximately 34 degrees. The transition section (63) overlaps an angle of 203 degrees in the exemplary embodiment. The radius of the inner wall of the transition section (63) is 2 millimetres, for example. In the exemplary embodiment, the radius central line lies on the intersection line of the plane of the contact surface (59) and a reach-under plane of the reach-under web (58). The radius central line can also be outside this intersection line. In the exemplary embodiment, the curved section (61) has a constant thickness of 1.5 millimetres, for example. This is the minimum thickness of the reach-around arm (51; 91), for example.

The width of the reach-under web (58) corresponds to the width of the guide rail (21; 121). The thickness of the reach-under web (58) corresponds to the thickness of the curved section (61), for example.

A holding web (64) adjoins the reach-under web (58). This holding web forms the free end (57) of the reach-around arm (51). The height of the holding web (64) orientated in the vertical direction (7) is about a third greater than the thickness of the reach-under web (58). The transition radius between the reach-under web (58) and the holding web (64) is for example a tenth of the radius of the transition section (63). The deflection is 90 degrees, so that the holding web (64) is orientated parallel to the bearing web (54).

Figure 7:
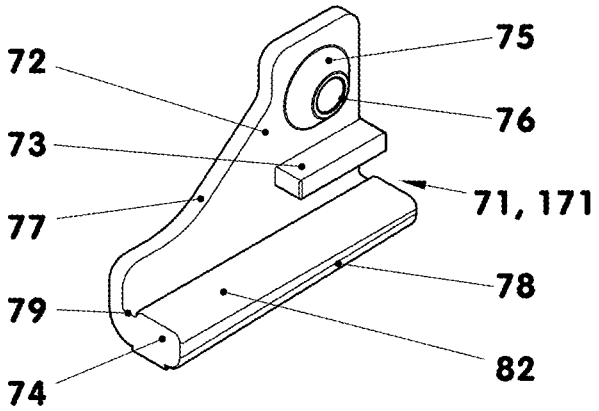
FIG. 7: Isometric view of an engagement arm of a first adapter.
Figure 8:
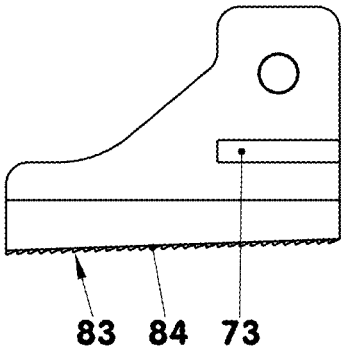
FIG. 8: Side view of the engagement arm from FIG. 7.
Figure 9:
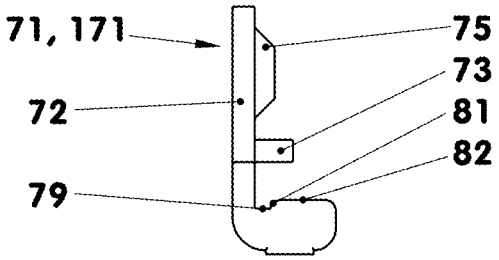
FIG. 9: End view of the engagement arm from FIG. 7.

FIGS. 7-9 show the engagement arm (71; 171) of the first adapter (50) in an isometric view, a side view and an end view. The engagement arm (71; 171) of the first adapter (50) of the right-hand acceleration and deceleration system (40), for example, is formed as a mirror image of the engagement arm (171) of the left-hand acceleration and deceleration system (140), for example. The engagement arm (71; 171) has an outer web (72), a supporting web (73) and a cantilever web (74). The outer web (72) is fixed on the housing (41) together with the receiver support (52). In the fixing region, the outer web has a conical-shaped centring lug (75) which dips into the housing (41).

In the side view, the outer web (72) is formed as an irregular heptagon, for example. In the longitudinal direction (5), the lower region of the outer web (72) is about 2.7 times longer than the upper region having the fixing recess (76). A transition region (77) connects the upper region to the lower region. For example, all transitions are rounded.

In the exemplary embodiment, the supporting web (73) is arranged on the inner side of the engagement arm (71; 171) in the transition region (77). It is orientated parallel to the upper side of the outer web (72). Its length in the longitudinal direction (5) corresponds to the length of the upper region of the outer web (72). Its width, orientated in the transverse direction, is 2.7 times the thickness of the outer web (72).

The cantilever web (74) is moulded on the lower end of the outer web (72). This cantilever web forms the free end (78) of the engagement arm (71). When the first adapter (50) is mounted, the free end (78) points in the direction of the bearing web (54) of the reach-around arm (51) and is orientated normal to the free end (57) of the reach-around arm (51). The cantilever web (74) has an envelope contour in the shape of a wedge portion. Its distance to the supporting web (73) is 1.7 times the thickness of the outer web (72). The upper side of the cantilever web (74) is parallel to the supporting web (73). It forms a holding surface (82). In the longitudinal direction (5), the length of the cantilever web (74) corresponds to the length of the lower region of the outer web (72). In the transverse direction (6), the width of the cantilever web is 3.6 times the thickness of the outer web (72), for example. The upper side has a receiving channel (79) bordering the outer web (72) in the transverse direction. The width of this receiving channel (79) is five eighths of the thickness of the outer web (72), for example. The contact region (82) borders the receiving channel (72) with a transition region (81). For example, this is increased by 40% of the thickness of the outer web (72) compared to the receiving channel (79).

The envelope plane of the lower side of the cantilever web (74) encloses an angle of 2 degrees with the contact surface (82) of the cantilever web (74). The imaginary vertex of the angle is orientated in the direction of the second adapter (90). A catch toothing (83) is impressed on the lower side of the cantilever web (74). The catch toothing (83) is directed in opposition to the increasing incline of the lower side. The two flanks of an individual tooth (84) enclose an angle of 66 degrees, for example. The steeper flank is orientated towards the end of the engagement arm (71; 171) facing away from the centring lug (75).

Figure 10:
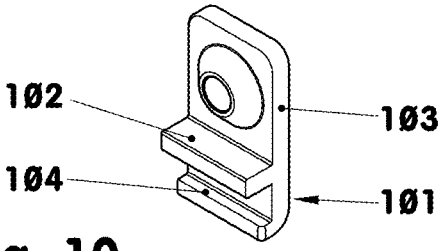
FIG. 10: Isometric view of an engagement arm of a second adapter.
Figure 11:
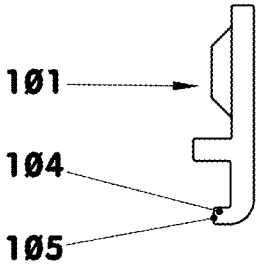
FIG. 11: End view of FIG. 10.

In FIGS. 10 and 11, the engagement arm (101) of the second adapter (90) is represented. Its length corresponds to the length of the upper region of the engagement arm (71) of the first adapter (50). It has a supporting web (102) which in the mounted state is flush with the supporting web (73) of the engagement arm (71) of the first adapter (50). These supporting webs (73, 102) rest on the lower side of the housing (41) in the mounted state. The engagement arm (101) of the second adapter (90) has an outer web (103) of a constant length and a cantilever web (104) orientated normal to this. The cantilever web (104) forms a free end (105) of the engagement arm (101) of the second adapter (90). The transition between the outer web (103) and the cantilever web (104) is formed as described in the context of the first engagement arm (71). The thickness of the outer web (103) of the engagement arm (101) of the second adapter (90) corresponds to the thickness of the outer web (72) of the engagement arm (71) of the first adapter (50). The height of the cantilever web (104) of the second adapter (90) and its width are three quarters of this thickness. The length of the cantilever web (104) in the longitudinal direction (5) is five and a half times the mentioned thickness. Therefore, in the exemplary embodiment, the cantilever web (74) of the first engagement arm (71) has more than double the extent of the cantilever web (104) of the second engagement arm (101) in the vertical direction (7), the width direction (6) and the longitudinal direction (5). These length ratios exist in at least two dimensions. The free end (105) of the engagement arm (101) of the second adapter is orientated normal to the free end (57) of the reach-around arm (91) of the second adapter (90).

Figure 14:
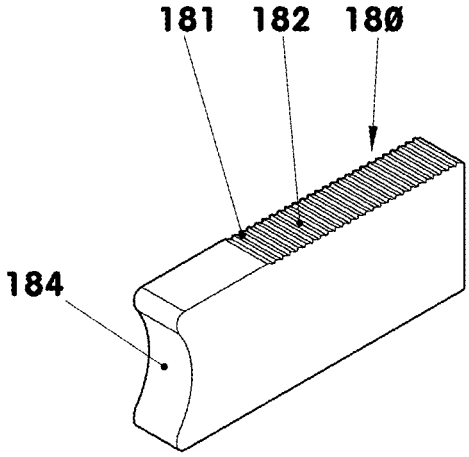
FIG. 14: Wedge element.
Figure 15:
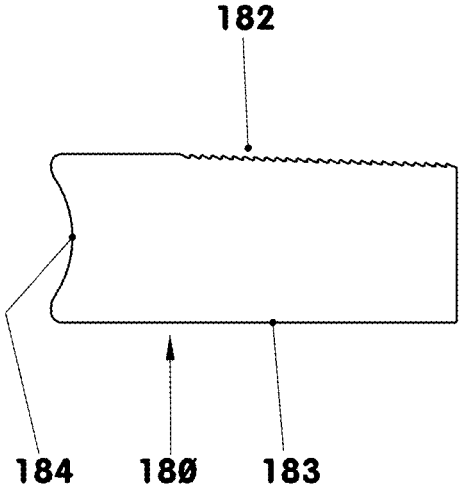
FIG. 15: Side view of FIG. 14.

In FIGS. 14 and 15, a wedge element (180) is represented. In the exemplary embodiment, in each case a wedge element (180) is assigned to an acceleration and deceleration system (40; 140). In the exemplary embodiment, the wedge element (180) has a thickness of 5.8 millimetres. The maximum height is 2.7 times this value, for example. In the exemplary embodiment, the length is 6.55 times the mentioned value of the thickness, for example. The incline of the wedge surface (181) corresponds to the incline mentioned in connection with the first engagement arm (71; 171). This wedge surface (181) supports a catch toothing (182) whose individual teeth are like the teeth (84) of the first engagement arm (71; 171). The tooth pairing (185) having the wedge element (180) and the first engagement arm (71; 171) is formed so that the two toothed wedge surfaces (82, 181) can be displaced relative to each other in a catching manner during parallel positioning of the upper side of the cantilever web (74) of the first engagement arm (71; 171) and the lower side (183) of the wedge element (180). To displace the wedge element (180), this has a tool engaging recess (184). The individual wedge element (180) can be moulded on the first engagement arm (71; 171) at least in the delivery condition.

Figure 12:
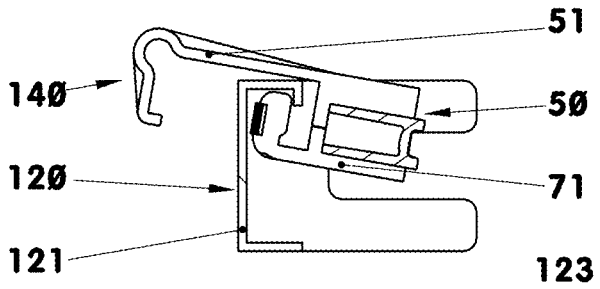
FIG. 12: Attaching the combined acceleration and deceleration system during mounting.
Figure 13:
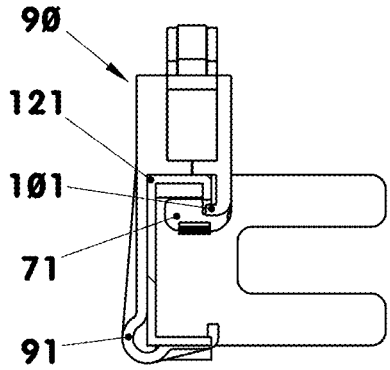
FIG. 13: Cross-section of the guide rail and the combined acceleration and deceleration system mounted thereon.

For mounting, a first adapter (50) and a second adapter (90) are mounted on the housing (41) of acceleration and deceleration apparatus. The resulting combined acceleration and deceleration system (40; 140) is attached to the inner side of the guide rail (21; 121) in such a way that the engagement arms (71, 101) dip into the guide rails (21; 121), see FIG. 12. In this case, the engagement arm (71; 171) of the first adapter (50) determines the mounting position of the acceleration and deceleration system (40; 140). Subsequently, the acceleration and deceleration system (40; 140) is pivoted around the longitudinal axis such that the reach-around arms (51, 91) reach around the guide rail (21; 121) and the bearing webs (54) rest on the rear webs (26) of the guide rail (21; 121). The reach-around arms (51, 91) latch onto the guide rail (21; 121) when pivoted further, see FIG. 13. This mounting takes place without tools.

In order to permanently secure the position of the acceleration and deceleration system (40; 140) and the guide rail (21; 121) relative to each other, the wedge element (180) is used. This is introduced and pressed into the guide rail (21; 121) in the region of the first adapter (50). The catch toothing (182) of the wedge element (180) engages with the catch toothing (83) of the engagement arm (71; 171) of the first adapter (50). When the wedge element (180) is pressed in further, the two catch toothings (83, 182) latch onto each other. The wedge element (180) and the engagement arm (71; 171) are pushed apart and pressed against the inner sides of the guide rails (21; 121) so that the first adapter (50) is non-positively locked in the guide rail (21; 121). The first adapter (50) is referred to as a locking adapter (50) in the following.

The second adapter (90) secures the position of the acceleration and deceleration system (40; 140) during the movement of the drawer (11). This second adapter (90) is referred to as a guide adapter (90) in the following.

Mounting the acceleration and deceleration system (40; 140) on the guide rail (21; 121) can take place before or after the installation of the drawer (11). Thus, the acceleration and deceleration system (40; 140) can be retrofitted onto an existing drawer guide system. The rollers of the drawer (11) can be used to press the wedge elements (180) on both sides.

During operation of the drawer system (10), each of the drivers (17) on both sides contacts a driving element (42) of an acceleration and deceleration system (40; 140) when the drawer (11) is closed.

The respective driving element (42) is released from its parking position (49). The drawer (11) is decelerated by means of the cylinder-piston unit (45) and is pulled into the closed end position by means of the discharged energy storage device (44), e.g. the tensioned spring element (44).

When the drawer (11) is opened, it pulls the driving elements (42) from the end position into the parking position (49) by means of the driver (17). The respective energy storage device (44) is loaded. The locking adapter (50) prevents a movement of the acceleration and deceleration system (40; 140) relative to the guide rail (21; 121) by means of its engagement arm (71; 171) and, if necessary, also by means of the wedge element (180). The guide adapter (90) secures the position of the driving element (42) to the driver (17) so that this does not unhook. The individual acceleration and deceleration system (40; 140) remains in its position relative to the guide rail (21; 121).

A combination of the individual exemplary embodiments is also conceivable.

LIST OF REFERENCE NUMERALS

5 longitudinal direction
6 transverse direction
7 vertical direction
10 system, drawer system
11 drawer
12 drawer compartment
13 base
14 longitudinal walls
15 front transverse wall
16 rear transverse wall
17 driver
20 guide system
21 guide rail
22 thrust bearing
23 opening of (21)
24 upper web
25 reach-around web
26 rear web
27 lower web
28 bulge
31 mounting rail
40 combined acceleration and deceleration system
41 housing
42 driving element
43 guide track
44 energy storage device, spring element
45 deceleration apparatus, cylinder-piston unit
46 cylinder
47 piston rod
48 piston rod head
49 parking position
50 adapter, first adapter, locking adapter
51 first arm, reach-around arm
52 receiver support
53 through bolt
54 bearing web
55 outer side
56 stiffening web
57 free end of (51)
58 reach-under web
59 contact surface
61 curved section
62 inlet section
63 transition section
64 holding web
65 supporting web
71 arm, engagement arm
72 outer web
73 supporting web
74 cantilever web
75 centring lug
76 fixing recess
77 transition region
78 free end of (71)
79 receiving channel
81 transition region
82 contact region, contact surface
83 catch toothing
84 tooth of (83)
90 adapter, second adapter, guide adapter
91 arm, reach-around arm
101 arm, engagement arm
102 supporting web
103 outer web
104 cantilever web
105 free end of (101)
120 guide system
121 guide rail
122 thrust bearing
123 opening of (121)
140 combined acceleration and deceleration system
171 engagement arm
180 wedge element
181 wedge surface
182 catch toothing
183 lower side of (180)
184 tool engaging recess
185 tooth pairing

The invention claimed is:

1. A combined acceleration and deceleration system (40; 140) for use on a drawer system having a C-shaped drawer guide rail and a drawer (11) guided therein, the system (40; 140) comprising:

a housing (41); and a driving element (42) arranged in the housing (41), wherein the driving element (42) is loaded by a deceleration apparatus (45) and an energy storage device (44) and wherein the driving element (42) can be moved between a secured parking position (49) and an end position, wherein the housing (41) supports a first adapter (50) and a second adapter (90), wherein the first adapter (50) and the second adapter (90) each have an engagement arm (71; 171; 101) having a free end (78; 105) and a reach-around arm (51; 91) having a free end (57), wherein the free end (78; 105) of the engagement arm (71; 171) is orientated normal to the free end (57) of the reach-around arm (51; 91), wherein the first adapter (50) is a locking adapter (50), wherein the second adapter (90) forms a guide adapter (90), wherein the engagement arm (71; 171) of the locking adapter (50) is at least twice as long in at least two mutually orthogonal directions as the engagement arm (101) of the second adapter (90).

2. The combined acceleration and deceleration system (40; 140) according to claim 1, wherein each reach-around arm (51; 91) has a receiver support (52), a bearing web (54) adjacent to the receiver support (52), a reach-under web (58) orientated normal to the bearing web (54), and a holding web (64) orientated normal to the reach-under web (58) and parallel to the bearing web (54).

3. The combined acceleration and deceleration system (40; 140) according to claim 2, wherein a curved section (61) is formed between a contact surface (59), in a contact plane, of the bearing web (54) and a reach-under surface, in a reach-under plane, of the reach-under web (58), and wherein a radius center line of the curved section (61) lies on or outside of an imaginary intersection line of the contact plane and the reach-under plane.

4. The combined acceleration and deceleration system (40; 140) according to claim 1, wherein the reach-around arms (51; 91) of both adapters (50, 90) have an identical design.

5. The combined acceleration and deceleration system (40; 140) according to claim 2, wherein each engagement arm (71; 171; 101) has an outer web (72) and a cantilever web (74; 104) that is orientated normal to the outer web (72) and that has the free end (78; 105).

6. The combined acceleration and deceleration system (40; 140) according to claim 5, wherein the cantilever web (74) of the locking adapter (50) is wedge-shaped in a longitudinal direction (5).

7. The combined acceleration and deceleration apparatus (40; 140) according to claim 1, wherein a wedge element (180) is molded on the locking adapter (50) by a tear-off web.

8. A guide system (10), comprising:

a C-shaped guide rail (21; 121); and the combined acceleration and deceleration system (40; 140) according to claim 5, wherein the C-shaped guide rail has an upper web (24), a rear web (26) and a lower web (27), wherein the cantilever webs (74, 104) of both engagement arms (71; 101) reach under the upper web (24), wherein the bearing webs (54) of both reach-around arms (51; 91) bear on the rear web (26), and wherein the reach-under webs (58) and the holding webs (64) together with the bearing webs (54) reach around the lower web (27) in a clamping manner.

9. The guide system according to claim 8, wherein a wedge element (180) secures the engagement arm (71; 171) of the locking adapter (50) in the guide rails (21; 121), and wherein a catch toothing (182) of the wedge element (180) engages into a catch toothing (83) of the cantilever web (74) of the first adapter (50).

10. A system, comprising:

two guide systems (10) according to claim 8; and a drawer (11) guided in the guide rails (21, 121) of the guide systems (10), wherein the drawer (11) has a driver (17) on each of its longitudinal side which in each case can be brought into contact with the driving element (42) of one of the guide systems (10).

* * * * *